US006454257B1

(12) United States Patent
Cisar

(10) Patent No.: US 6,454,257 B1
(45) Date of Patent: Sep. 24, 2002

(54) ARTICLE JOGGING APPARATUS

(75) Inventor: George Cisar, Gurnee, IL (US)

(73) Assignee: Versa Tech, L.L.C., Willowbrook, IL (US)

( * ) Notice: Subject to any disclaimer, the term of this patent is extended or adjusted under 35 U.S.C. 154(b) by 41 days.

(21) Appl. No.: 09/639,653

(22) Filed: Aug. 15, 2000

(51) Int. Cl.[7] ..... B65H 9/04

(52) U.S. Cl. ..... 271/254; 271/185; 271/240; 271/248; 198/456

(58) Field of Search ..... 198/456; 414/789.1; 271/226, 234, 238, 240, 248, 253, 254, 184, 185, 249, 250

(56) References Cited

U.S. PATENT DOCUMENTS

| | | | | |
|---|---|---|---|---|
| 1,448,301 A | | 3/1923 | Hotchkiss | |
| 2,488,551 A | * | 11/1949 | Nordquist et al. | 271/240 |
| 2,490,085 A | * | 12/1949 | Nordquist et al. | 271/238 |
| 2,528,106 A | * | 10/1950 | Albrecht | 271/240 |
| 2,602,554 A | * | 7/1952 | Griffith | 198/456 |
| 3,172,656 A | * | 3/1965 | Mestre | 198/456 |
| 3,871,644 A | * | 3/1975 | Stobb | 271/186 |
| 3,949,982 A | | 4/1976 | Snellman et al. | |
| 4,015,843 A | | 4/1977 | Tennant | |
| 4,087,001 A | | 5/1978 | Daisley | |
| 4,381,108 A | | 4/1983 | Newsome | |
| 4,511,131 A | | 4/1985 | Raybuck | |
| 4,607,831 A | | 8/1986 | Raybuck | |
| 4,667,809 A | | 5/1987 | Raybuck | |
| 4,767,116 A | | 8/1988 | Eberle | |
| 4,919,414 A | * | 4/1990 | Marschke et al. | 271/176 |
| 5,048,817 A | | 9/1991 | Roller | |
| 5,203,246 A | * | 4/1993 | Smitterberg et al. | 271/240 |
| 6,126,163 A | * | 10/2000 | Katsuta et al. | 270/58.08 |

FOREIGN PATENT DOCUMENTS

| | | |
|---|---|---|
| DE | 30 45 049 C 2 | 7/1983 |
| DE | 33 07 463 A 1 | 9/1983 |
| DE | 32 38 683 A 1 | 4/1984 |
| DE | 33 12 122 C 2 | 6/1985 |
| DE | 0 163 256 B 1 | 2/1988 |
| DE | 38 00 583 A 1 | 7/1989 |
| DE | 0 472 984 A 1 | 9/1991 |
| DE | 40 27 433 A 1 | 3/1992 |
| DE | 39 31 673 C 2 | 12/1992 |
| DE | 42 11 658 A 1 | 10/1993 |
| DE | 42 35 413 A 1 | 4/1994 |
| DE | 42 35 416 A 1 | 4/1994 |
| DE | 41 28 194 C 2 | 5/1994 |
| DE | 42 02 735 C 2 | 6/1994 |
| DE | 43 09 485 A 1 | 9/1994 |
| DE | 195 19 707 A 1 | 12/1995 |
| DE | 44 34 397 C 2 | 12/1996 |
| DE | 37 90 154 C 2 | 4/1998 |
| DE | 196 43 684 A 1 | 4/1998 |
| DE | 198 13 120 A 1 | 7/1999 |
| DE | 198 13 139 C 1 | 9/1999 |
| EP | 0 095 816 A 2 | 12/1983 |
| EP | 0 124 269 A 1 | 11/1984 |
| EP | 0 396 979 B 1 | 4/1990 |
| EP | 0 641 811 B1 | 1/1993 |
| EP | 0 739 834 A 2 | 4/1996 |
| GB | 1 451 722 | 10/1976 |
| GB | 2 234 954 A | 8/1989 |
| GB | 2 273 089 A | 6/1994 |

* cited by examiner

*Primary Examiner*—Christopher P. Ellis
*Assistant Examiner*—Patrick Mackey
(74) *Attorney, Agent, or Firm*—Cook, Alex, McFarron, Manzo, Cummings & Mehler

(57) ABSTRACT

An article jogging apparatus for the lateral straightening of sheet material located on a conveyor includes a pair of vertically opposed timing belts. One belt being adjustable per product width as well as stream throat. The other belt oscillating between a reference and a thrown position to realign those articles of the stream that are out of alignment. The apparatus utilizes a uniquely assembled drive pulley and position system.

13 Claims, 6 Drawing Sheets

ARTICLE JOGGING APPARATUS

BACKGROUND OF THE INVENTION

The present invention relates generally to an apparatus for the lateral straightening or alignment of sheet material located on a conveyor and more particularly to an apparatus for aligning folded printed paper booklets commonly known as signatures, i.e. overlapping, stream from a preceding web press, combination folder or flow folding station.

The printing industry yields a vast amount of sheet-like product or articles which have a major plane and a typically rectangular or square perimeter. These articles, or "signatures" as they are referred to in the art, leave the printing press or folding machine where they are subsequently acted upon in a stream in some way. For example, they may be counted, folded, cut, etc. perhaps on their way to be eventually stacked. These successive articles have a forward end and a back end where the front of the articles overlap the back of the succeeding articles to form a shingled stream. As such, the stream is transferred from one operation to the next, such as to further delivery equipment, and eventually leading to a stacking machine where a preset number of articles may form a stack and become ready for further processing or transportation.

The stream of articles from the printing press or folding station are usually, for one reason or another, considerably out of alignment. Accordingly, it is necessary to employ a means to align the signatures before they are fed to the next operation. To achieve accurate alignment it has been customary in the past to employ vibrating joggers acting upon the presented edges of the signatures on either one or both sides of the stream. Such joggers have worked satisfactorily where the amount of misalignment of a given signature with respect to the stream is small, where the signatures are made of relatively stiff paper stock, and where the friction between adjacent signatures is not excessive. However, under more severe conditions, these conventional joggers have proved rather inadequate. For example, under gross misalignment and/or the use of flimsy stock having a high coefficient of friction, the engaged edge, or corner, of the signature is simply bent over rather than being pushed into the desired aligned position, thereby compounding the misalignment and making subsequent downline processing impossible.

Typically, such joggers include a fixed slide plate on one side of the signature stream and a pivoted jogger plate on the other side which is pivoted back and forth so that it alternately slightly compresses the signature flow against the fixed slide plate and then releases the signature flow to provide a rough alignment of the overlapped signatures. Alternatively, such joggers may include dual pivoted adjacent jogger plates. In any event, these joggers are necessarily cam actuated, and, notwithstanding the previously discussed problems, such cam actuation presents a machine movement problem. In particular, since the articles are alternately bent and then are allowed to straighten suddenly as the cam operates, the sudden straightening frequently causes the signatures to again bounce out of alignment. This problem is intensified at high speeds since the oscillation action has a tendency to disturb the alignment with respect to articles in both the downstream and upstream line.

Another typical jogger design includes guide members in the form of endless belts arranged on opposite sides of the stream. These belts are moving in the same direction and at approximately the same speed as the stream as they are continuously conveying/diverging towards/away from one another at the width of the stream. Thus, the sides of the belts running along the stream reciprocally move towards one another to the width of the stream to move together the disordered articles. Although this design may facilitate some of the previously-mentioned problems, it does not solve all of them, and, in fact, amplifies the signature bending drawback. In particular, when a signature is not in alignment, one of its corners is necessarily forced in towards the stream for realignment. However, since one corner is out of alignment, the opposite corner must be out of alignment as well and is similarly forced in towards the stream for realignment. Thus, the signature is susceptible to bending, thereby causing the shingled stream to progress increasingly out of alignment, thereby reversing the joggers' purpose.

Irrespective of which current jogger design is utilized, the deficiencies yet remain. These deficiencies lead to downtime and loss of operating efficiency in the conveyor system. This subsequently is responsible for the delay and/or cancellation in the product delivery system. Therefore, article jogging, which leads to correct stream alignment is essential to maintain a low cost and expense of the system while ensuring a timely delivery of the product.

By contrast to the current jogger designs, the present invention laterally straightens the alignment of sheet material located on a conveyor without the disadvantages of the aforementioned deficiencies. Accordingly, it is an object of the present invention to provide a new and improved article jogging apparatus that overcomes the deficiencies of the current practices whereby an apparatus is provided for the alignment of signatures which minimizes cost while ensuring a timely delivery.

It is an object of the present invention to provide an article jogging apparatus that reduces the occurrence of bending articles due to inadequate camming actuation.

It is another object of the present invention to provide an article jogging apparatus that reduces the occurrence of bending articles due to adjacent reciprocating jogger belts.

Yet another object of the present invention is to provide an article jogging apparatus that disturbs only the misaligned articles, bringing them back into alignment, without disturbing the properly-aligned articles.

It is yet another object of the present invention to provide an article jogging apparatus capable of accommodating various product widths.

These and other objects, features and advantages of the present invention will be clearly understood through a consideration of the following detailed description.

SUMMARY OF THE INVENTION

According to the present invention, there is provided an apparatus for aligning sheet like articles in a stream carried on a conveyor surface moving at a predetermined speed. The stream is passed between two guide members having vertically arranged timing belts moving at the same speed as the stream. One guide member is fixedly positioned relative to one edge of the stream, while the other is positioned adjacent thereto and oscillating between a reference position and a thrown position. The thrown position thereof urging misaligned articles back into stream alignment.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the several figures of which like reference numerals identify like elements, and in which:

DESCRIPTION OF THE PREFERRED EMBODIMENT

Figure 1:
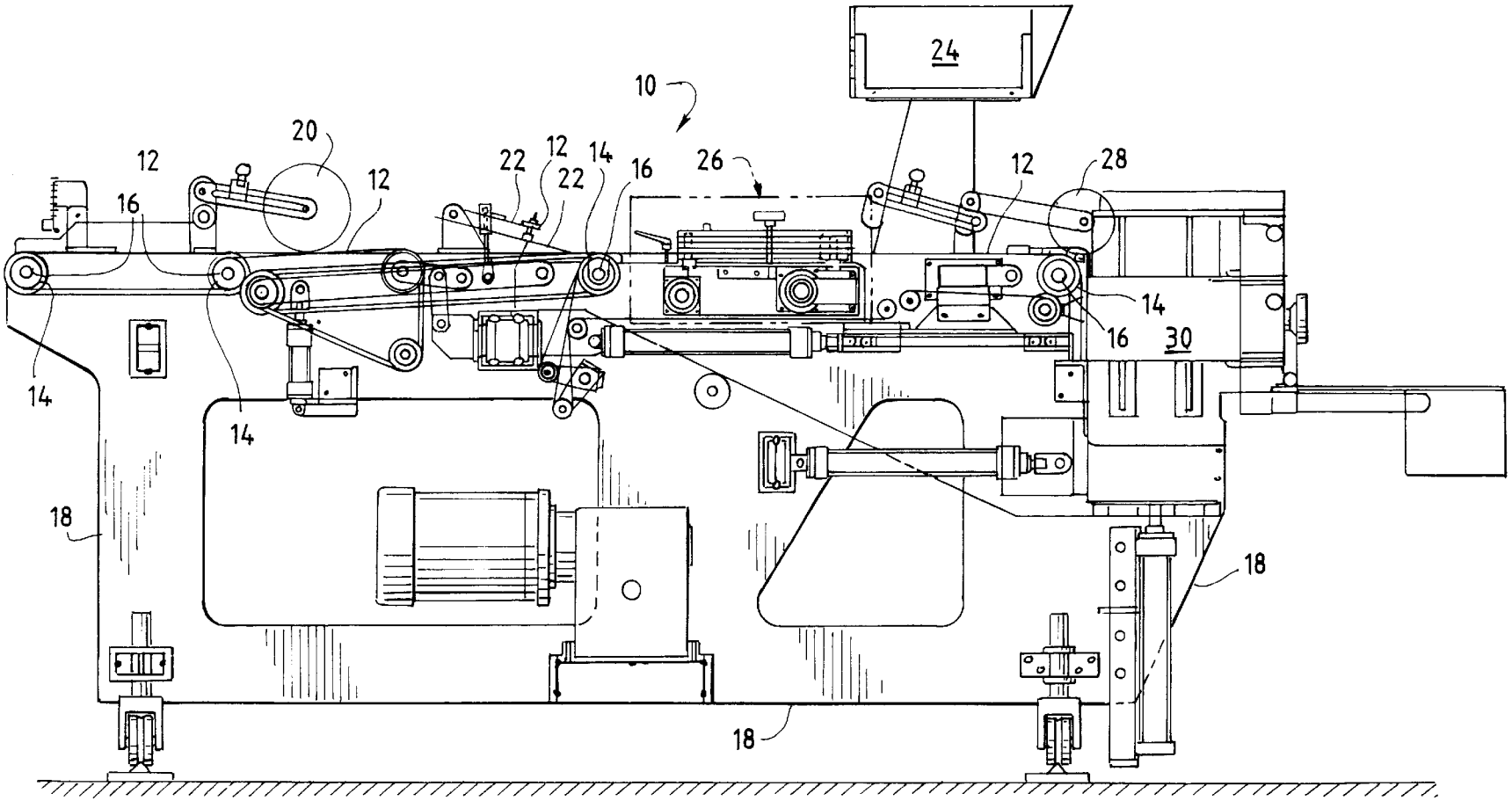
FIG. 1 is a side view of an article manipulating system incorporating the jogging apparatus of the present invention.

The preferred embodiment of the article jogging apparatus will be shown and described as a component of a complete article manipulating system. More particularly, and referring generally to FIG. 1, an article manipulating system 10 is shown comprised of multiple component parts. The major components of this particular system are fed by multiple conveying belts 12 which transport the stream of articles from one component (or station) to another on their way through the system 10.

The stream of articles may be generated from a product source such as a printing press and the like, and the present invention will be described as capable of receiving a double stream of such articles. This double stream not only saves time and money, but enables a single workman to handle double the product with only occasional work breaks. Irrespective of the number of streams of articles entering the system 10, they are transported by the conveying belts 12 which form a series of endless conveyors around main belt pulleys 14. These main belt pulleys 14 are supported by shafts 16 inserted into flange units integral with the frame 18 of the system 10.

To provide for a more uniform and rectangular stack at the end of the system, the articles sometimes need to be crushed and/or flattened. Once the articles enter the system, they may be passed under a beltless crusher roller where they subsequently exit in the flattened state. Typical systems provide for the upper crusher roller to be mounted on self-aligning bearings in order to better follow the uneven profile of the shingled article stream. In particular, an air cylinder provides for an adjustable pressure to the crusher roller, and since it is a dual piston cylinder, half of it is filled with hydraulic fluid and metered to provide for shock absorption as the roller "bumps" over the shingled articles. Although the present system does not utilize such a roller, in fact it only uses a top wheel 20 assembly, it will be apparent that same can be easily substituted therewith.

The conveyor belts 12 then transport the articles to the next station in the system, the gapping station. This station comprises, in the preferred embodiment, of interrupt fingers 22 which are lowered onto the stream of articles to stop its flow and create a gap therein upon the processor reaching the predetermined article count. In other words, the system is typically set to eventually handle or stack a predetermined amount of articles. The internal processor is set, at the control station 24, to stack this desired amount, and when the system counts thereto the stream is interrupted. Specifically, the main gapper air cylinder is actuated upon reaching this count, which pulls the gap cylinder rod-end down. Through a series of linkages, this action eventually lowers the fingers 22 which creates a gap in the stream.

After being divided into the desired number of articles per stream, the stream then passes through the article jogging apparatus 26 of the present invention where the stream is realigned before entering the stacking station. The stacking station comprises an accelerator roller 28 to aide the exit of the articles onto the stack table 30. Upon reaching the desired count upon the table 30, the stack in compressed and expelled from the system while the next stack is being formed.

Figure 2:
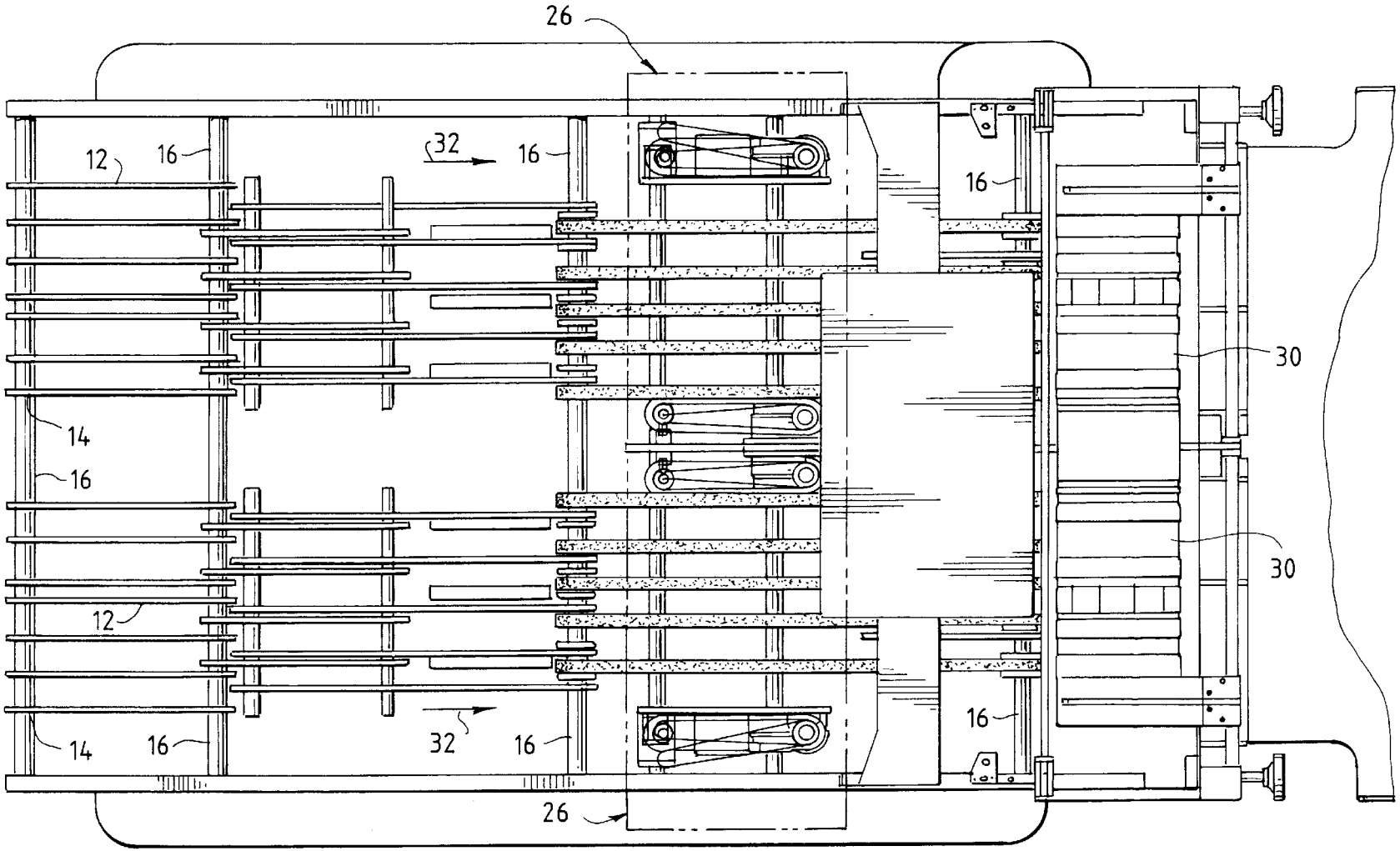
FIG. 2 is a top plan view of the system of FIG. 1 illustrating dual feeding conveyors into the jogging apparatus of the present invention.

Referring to FIG. 2, and encompassing the double stream feeding of the aforementioned system, the stream of articles [not shown] move left-to-right 32 from the gapping station to the jogging apparatus 26. The articles first enter the system and are supported and transported by conveying belts 12 which form the series of endless conveyors around main belt pulleys 14. These main belt pulleys 14 are supported by shafts 16 inserted into flange units integral with the frame 18 of the system 10. Once the articles pass the jogging apparatus 26, they enter the stacking station and are stacked upon table 30, ejected from the system upon reaching the predetermined count, and the next stream is stacked.

Although the present invention will be described as it would cooperate with the illustrated system, it will be understood that the system of FIG. 1 is merely generic in nature. The present invention may be incorporated in a like system at a different point in the conveying process, or perhaps a completely different system. In any event, the present invention provides for an article-jogging apparatus for use with a variety of shingled stream needs and is not intended to be limited to a particular application thereof.

Figure 3:
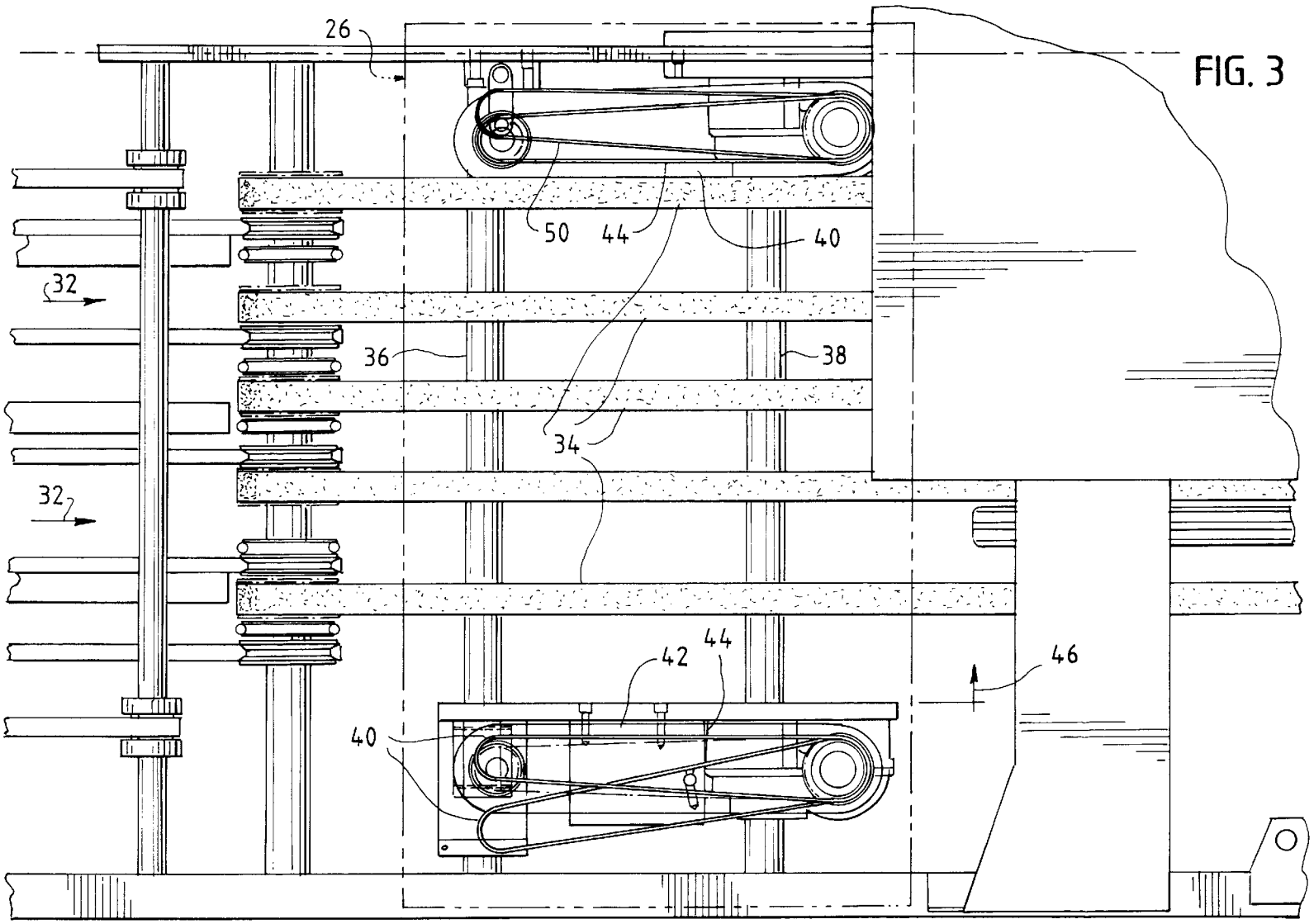
FIG. 3 is an enlarged view of the bottom feeding conveyor of FIG. 2.

Therefore, and referring now to FIG. 3, the left-to-right 32 moving articles enter the article jogging apparatus 26 while conveyed on stream carrier belts 34. This misaligned stream passes between the stream jogger 40 and the stream fence 42. FIG. 3 illustrates that the article jogging apparatus 26 is basically supported in the preferred embodiment by support shaft 36 and drive shaft 38, both of which are in turn supported by frame 18. Both the jogger 40 and the fence 42 have vertical belts 44 moving at the same speed as the stream conveyor belts 34. The fence 42 can accommodate various product widths as it is adjustable 46 toward and away from the stream centerline. Additionally, in order to help guide the stream of product into the jogging area, the fence 42 has an adjustable throat 48. Thus, as the vertical belts 44 are moving at the same speed as carrier belts 34, the articles are gently realigned by being urged by the adjustable fence 42 towards the oscillating 50 jogger 40.

Figure 4:
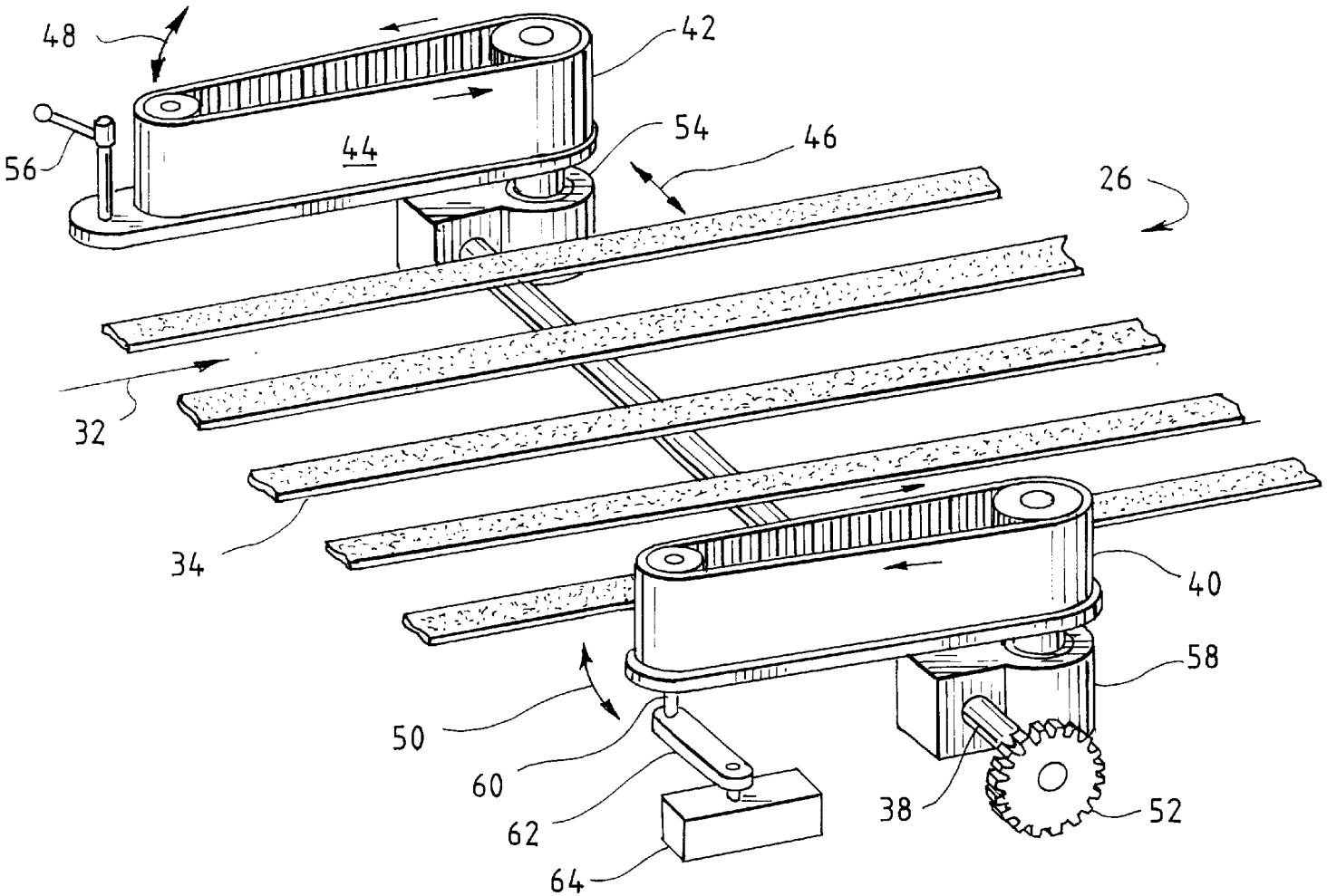
FIG. 4 is a perspective view of the major components of the jogging apparatus of the present invention.
Figure 5:
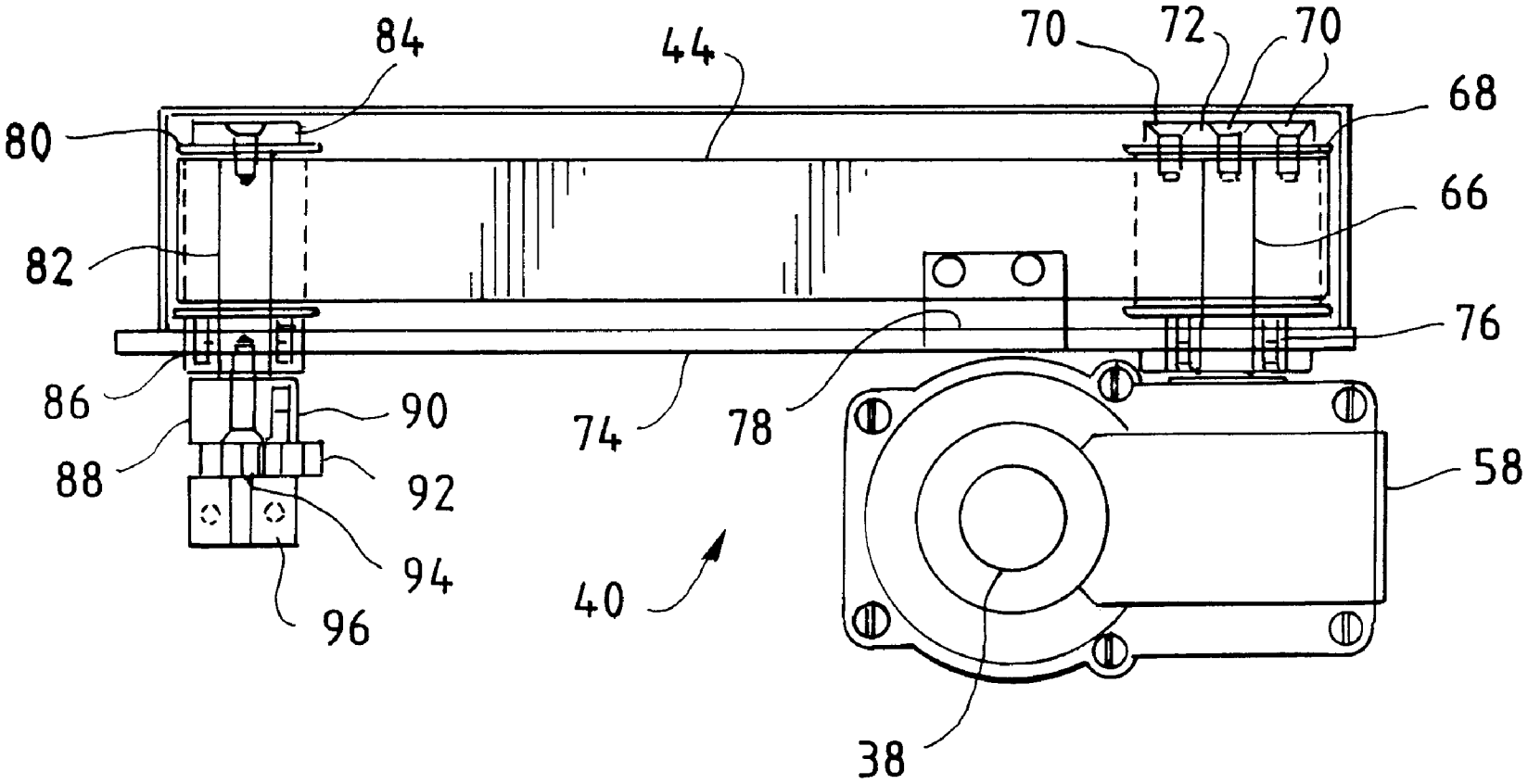
FIG. 5 is a side view of the oscillating jogger of the present invention.

Before delving into the detailed description of the jogger 40, and specifically FIGS. 5 and 6, the operation of the article jogging apparatus 26 may better be understood through the simplified description of FIG. 4. In order to adequately simplify this illustration, it is noted that the jogger 40 and fence 42 of FIG. 3 have now switched positions with each other in FIG. 4. During operation, the stream of articles (or product) is fed left-to-right 32 on the flat product carrier belt 34 between the jogger 40 and the fence 42. Both are shown supported, at least in part, by drive shaft 38 which is driven via main drive gear 52. To adjust 46 for product size, the fence gear box 54 slides and locks into position about shaft 38. Additionally, and as previously discussed, the fence throat is adjustable 48 through throat lock 56. The jogger 40, more fully discussed below, also has a gearbox 58, which as with fence gearbox 54 provides for a 90° power shift to power belts 44. However, the jogger is not adjustable, but instead oscillates 50 to gently jog the misaligned articles into the stream to provide for a uniformly aligned stream. This oscillation is accomplished through an eccentric pin 60 driving the pivot link 62 about the pivot block 64 which is affixed to the frame.

The jogger 40 of the article jogging apparatus 26 of the preferred embodiment will now be discussed in greater detail and in reference to FIGS. 5–6. Referring to FIG. 5, the drive shaft 38 rotation is converted to vertical rotation of jogger drive shaft 66 via 90° gearbox 58. Jogger drive shaft 66 rotation is imparted to main timing belt pulley 68 via bolts 70 and end plate 72. Conversely, jogger drive shaft 66 rotation is isolated from plate 74 via bearings 76, while the plate 74 is supported by friction plate 78.

Main timing belt pulley 68 thus rotates and drives timing belt 44 and, in turn, rotates the secondary timing belt pulley 80. Oscillating shaft 82 is bolted to, and rotates with pulley 80 via end plate 84. Further, shaft 82 rotation is isolated from plate 74 by bearing 86. The actuation by combination of drive shaft, belt pulley and timing belt of the fence 42 basically operates in the same fashion.

The rotation of shaft 82 is imparted to eccentric hub 88, thereby causing bearing pin 90 to rotate eccentrically and crank link arm 92 which pivots about pivot point 94. Pivot point 94 is affixed on the block 96 which, in turn, is bolted to the center frame 18. The overall effect is that the timing belt 44 moves at the same relative speed as the stream of printed products, and secondary timing belt pulley 80 oscillates at an amplitude equal to the eccentricity of hub 88.

Figure 6A:
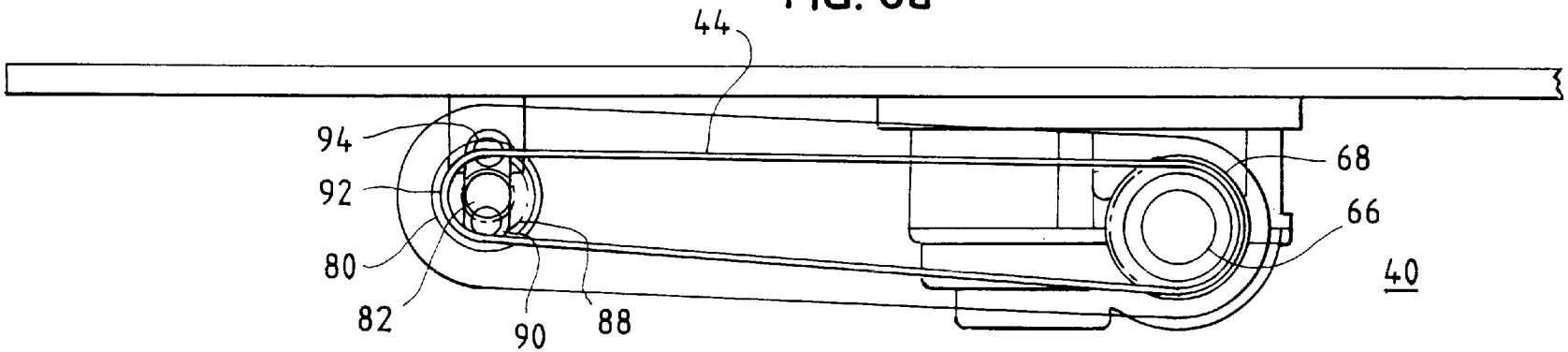
FIG. 6*a* is a top plan view of the oscillating jogger of FIG. 5 shown in the reference or planer position.
Figure 6B:
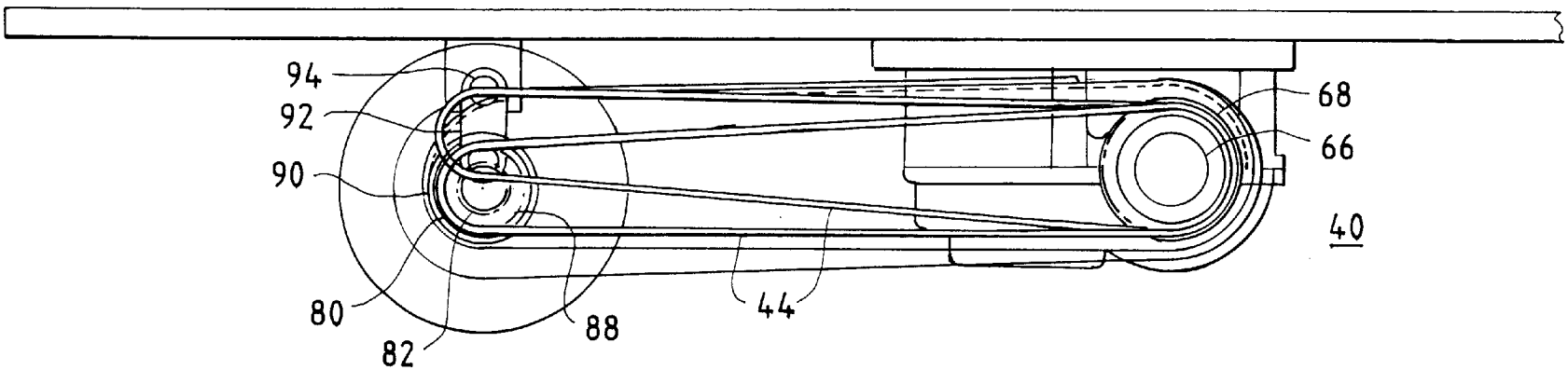
FIG. 6*b* is a top plan view of the oscillating jogger of FIG. 5 shown oscillating between the planer position and the thrown position.

The plan view of FIG. 6*a* shows the jogger 40 in its reference or planer position, while FIG. 6*b* shows the jogger 40 oscillating from its reference position to its thrown position. Again, jogger drive shaft 66 rotation is imported to main timing belt pulley 68 which rotates and drives timing belt 44 and, in turn, rotates the secondary timing belt pulley 80. The rotation of pulley 80 rotates oscillating shaft 82, which is imported to the eccentric hub 88. Thus, bearing pin 90 rotates and cranks link arm 92 which pivots about point 94. Therefore, as bearing pin 90 rotates about shaft 82, the timing belt 44 is oscillating between the reference and thrown position.

While a particular embodiment of the invention has been shown and described, it will be obvious to those skilled in the art that changes and modifications may be made therein without departing from the invention in its broader aspects and, therefore, the aim in the appended claims is to cover all such changes and modifications as fall within the true spirit and scope of the invention.

I claim:

1. An apparatus for aligning sheet articles in a stream carried on a conveyor surface moving at a predetermined speed, said apparatus comprising:

a first guide member having an endless vertical conveying belt adapted to be fixedly positioned relative to one edge of said stream of articles for guiding said stream of articles;

a second guide member having an endless vertical conveying belt moving at said predetermined speed, said second guide member positioned adjacent an opposite edge of said stream, said second guide member having a fixed end and an oscillating end, said oscillating end oscillating between a reference position and a thrown position; and a means for driving said endless belts in the direction of flow of said stream and at said predetermined speed, said driving means further providing for said oscillation whereby when said stream passes between said guide members and said oscillating end of said second guide member is in said thrown position, said stream is urged into alignment.

2. The apparatus as defined in claim 1, wherein said first guide member is adjustable toward and away from a centerline of said stream.

3. The apparatus as defined in claim 1, wherein said first guide member further having a fixed end and an adjustable end to provide for an adjustable throat for said stream.

4. The apparatus as defined in claim 1, wherein said oscillating end of said second guide member includes a shaft driven by said belt, said shaft rotating an eccentric pin driving a pivot link about a pivot point thereby oscillating said oscillating end between said reference and said thrown positions.

5. The apparatus as defined in claim 1, wherein said driving means includes a drive shaft coupled to guide member gear boxes to provide a 90° power shift to power said belts.

6. An apparatus for aligning sheet articles in a stream carried on a conveyor surface moving at a predetermined speed, said apparatus comprising:

a drive shaft;

a first guide member having an endless vertical conveying belt moving at said predetermined speed and positioned between a pair of pulleys, said first guide member adapted to be fixedly positioned relative to one edge of said stream of articles for guiding said stream of articles;

a second guide member having an endless vertical conveying belt moving at said predetermined speed and positioned between a pair of pulleys, said second guide member having a fixed end and an oscillating end, said oscillating end oscillating between a reference position and a thrown position; and a power translating gearbox coupling said drive shaft to one of said pulleys on each of said members whereby said endless belts are driven in the direction of flow of said stream and at said predetermined speed, said drive shaft further providing for said oscillation whereby when said stream passes between said guide members and said oscillating end of said second guide member is in said thrown position, said stream is urged into alignment.

7. The apparatus as defined in claim 6, wherein said first guide member is adjustable toward and away from a centerline of said stream.

8. The apparatus as defined in claim 6, wherein said first guide member further having a fixed end and an adjustable end to provide for an adjustable throat for said stream.

9. The apparatus as defined in claim 6, wherein said oscillating end of said guide member includes a shaft driven by said belt, said shaft rotating an eccentric pin driving a pivot link about a pivot point thereby oscillating said oscillating end between said reference and said thrown positions.

10. An apparatus for aligning sheet articles in a stream carried on a conveyor surface moving at a predetermined speed, said apparatus comprising:

a drive shaft;

a first guide member having an endless vertical conveying belt moving at said predetermined speed and positioned between a pair of pulleys, said first guide member adapted to be fixedly positioned relative to one edge of said stream of articles for guiding said stream of articles;

a second guide member having an endless vertical conveying belt moving at said predetermined speed and positioned between a pair of pulleys, said second guide member having a fixed end and an oscillating end;

a power translating gearbox coupling said drive shaft to one of said pulleys on each of said members whereby said endless belts are driven in the direction of flow of said stream at said predetermined speed; and one of said pulleys on said second guide member having a shaft with an eccentric hub, said hub rotates an attached pin eccentrically and cranks a link arm about a pivot point thereby oscillating one end of said second member between a reference position and a thrown position whereby when said stream passes between said guide members and said oscillating end is in said thrown position, said stream is urged into alignment.

11. The apparatus as defined in claim 10, wherein said first guide member is adjustable toward and away from a centerline of said stream.

12. The apparatus as defined in claim 10, wherein said first guide member further having a fixed end and an adjustable end to provide for an adjustable throat for said stream.

13. The apparatus as defined in claim 10, wherein said oscillating end of said second guide member includes a shaft driven by said belt, said shaft rotating an eccentric pin driving a pivot link about a pivot point thereby oscillating said oscillating end between said reference and said thrown positions.

* * * * *